US006942126B2

(12) United States Patent
Douglas et al.

(10) Patent No.: US 6,942,126 B2
(45) Date of Patent: Sep. 13, 2005

(54) CONFORMABLE POUCH RESERVOIR FOR SPRAY GUN

(75) Inventors: Malcolm F. Douglas, Swansea (GB); Phillip J. Bouic, Warwicks (GB); Stephen C. P. Joseph, Warwickshire (GB)

(73) Assignee: 3M Innovative Properties Company, St. Paul, MN (US)

( * ) Notice: Subject to any disclaimer, the term of this patent is extended or adjusted under 35 U.S.C. 154(b) by 62 days.

(21) Appl. No.: 10/430,952

(22) Filed: May 7, 2003

(65) Prior Publication Data

US 2003/0209568 A1 Nov. 13, 2003

(30) Foreign Application Priority Data

May 8, 2002 (GB) ..... 0210446

(51) Int. Cl.[7] ..... B05B 7/00

(52) U.S. Cl. ..... 222/386.5; 222/212; 239/313; 239/323; 239/327; 239/328

(58) Field of Search ..... 222/92, 95, 105, 222/377, 386.5, 389; 239/313, 323, 327, 328

(56) References Cited

U.S. PATENT DOCUMENTS

| | | | | |
|---|---|---|---|---|
| 1,703,384 A | | 2/1929 | Birkenmaier | |
| 2,152,862 A | | 4/1939 | Bergerioux | |
| 2,177,032 A | | 10/1939 | Baumgardner | |
| 2,208,744 A | | 7/1940 | Bergerioux | |
| 2,264,564 A | | 12/1941 | Connor | |
| 3,198,438 A | | 8/1965 | Hultgren | |
| 3,211,324 A | | 10/1965 | Sapien | |
| 3,236,459 A | | 2/1966 | McRitchie | |
| 3,255,972 A | | 6/1966 | Hultgren et al. | |
| 3,401,842 A | | 9/1968 | Morrison | |
| 3,432,104 A | | 3/1969 | Kaltenbach | |
| 3,507,309 A | | 4/1970 | Johnson | |
| 3,757,718 A | | 9/1973 | Johnson | |
| 3,780,950 A | | 12/1973 | Brennan | |
| 3,784,039 A | | 1/1974 | Marco | |
| 3,790,017 A | | 2/1974 | Fitzpatrick et al. | |
| 3,790,021 A | | 2/1974 | Bailey | |
| 3,862,708 A | * | 1/1975 | Waxlax | 222/444 |
| 4,043,510 A | | 8/1977 | Morris | |
| 4,122,973 A | | 10/1978 | Ahern | |
| 4,151,929 A | | 5/1979 | Sapien | |

(Continued)

FOREIGN PATENT DOCUMENTS

| | | |
|---|---|---|
| AU | 200032550 A | 7/2000 |
| AU | 199935838 A | 1/2001 |

(Continued)

OTHER PUBLICATIONS

Service Bulletin, SB–4–043–D, Replaces SB–4–043–C, DeVilbiss, "120175 (GFC–502) 32 oz. Aluminum Gravity Feed Cup with Disposable Lid and Cup Liner", May, 2000. (*53022).

*Primary Examiner*—J. Casimer Jacyna
(74) *Attorney, Agent, or Firm*—Pamela L. Stewart

(57) ABSTRACT

A reservoir for use with a spray gun has a body and a flexible diaphragm that define a chamber for liquid to be supplied to the spray gun. The body has an outlet opening leading to a spout connectable to the spray gun and the diaphragm deflects to reduce the volume of the chamber as liquid is withdrawn from the reservoir. The diaphragm gradually conforms to the internal surface of the body as the liquid is withdrawn to prevent pockets forming in which the liquid may be trapped so that substantially all the liquid can be dispensed. The reservoir may be supplied pre-filled with the liquid.

20 Claims, 11 Drawing Sheets

U.S. PATENT DOCUMENTS

| | | | |
|---|---|---|---|
| 4,321,922 | A | 3/1982 | Deaton |
| 4,339,046 | A | 7/1982 | Coen |
| 4,347,948 | A | 9/1982 | Hamada et al. |
| 4,379,455 | A | 4/1983 | Deaton |
| 4,383,635 | A | 5/1983 | Yotoriyama |
| 4,403,738 | A | 9/1983 | Kern |
| 4,406,406 | A | 9/1983 | Knapp |
| 4,558,792 | A | 12/1985 | Cabernoch et al. |
| 4,562,965 | A | 1/1986 | Ihmels et al. |
| 4,586,628 | A | 5/1986 | Nittel |
| 4,657,151 | A | 4/1987 | Cabernoch |
| 4,723,712 | A | 2/1988 | Egli et al. |
| 4,760,962 | A | 8/1988 | Wheeler |
| 4,811,904 | A | 3/1989 | Ihmels et al. |
| 4,813,556 | A | 3/1989 | Lawrence |
| 4,836,764 | A | 6/1989 | Parkinson |
| 4,936,511 | A | 6/1990 | Johnson et al. |
| 4,951,875 | A | 8/1990 | Devey |
| 4,971,251 | A | 11/1990 | Dobrick et al. |
| 5,052,623 | A | 10/1991 | Nordeen |
| 5,094,543 | A | 3/1992 | Mursa |
| 5,143,242 | A | 9/1992 | Millasich |
| 5,143,294 | A | 9/1992 | Lintvedt |
| 5,186,828 | A | 2/1993 | Mankin |
| 5,209,501 | A | 5/1993 | Smith |
| 5,328,095 | A | 7/1994 | Wickenhaver |
| 5,337,921 | A | 8/1994 | Wilson et al. |
| 5,385,251 | A | 1/1995 | Dunn |
| 5,405,090 | A | 4/1995 | Greene et al. |
| 5,424,086 | A | 6/1995 | Walker |
| 5,454,488 | A | 10/1995 | Geier |
| 5,460,289 | A | 10/1995 | Gemmell |
| 5,492,242 | A | 2/1996 | Gall |
| 5,582,350 | A | 12/1996 | Kosmyna et al. |
| 5,607,082 | A | 3/1997 | Cracauer |
| 5,617,972 | A | 4/1997 | Morano et al. |
| 5,655,714 | A | 8/1997 | Kieffer et al. |
| D386,654 | S | 11/1997 | Kosmyna |
| 5,772,079 | A | 6/1998 | Gueret |
| 5,789,684 | A | 8/1998 | Masek et al. |
| 5,797,520 | A | 8/1998 | Donahue |
| 5,806,711 | A | 9/1998 | Morano et al. |
| 5,816,501 | A | 10/1998 | LoPresti et al. |
| 5,829,588 | A | 11/1998 | Bloomfield |
| 5,853,102 | A | 12/1998 | Jarrett |
| 5,996,427 | A | 12/1999 | Masek et al. |
| 6,019,294 | A | 2/2000 | Anderson et al. |
| 6,053,429 | A | 4/2000 | Chang |
| 6,092,740 | A | 7/2000 | Liu |
| 6,196,410 | B1 | 3/2001 | Hocking |
| 6,257,429 | B1 | 7/2001 | Kong |
| 6,820,824 | B1 | 11/2004 | Joseph et al. |

FOREIGN PATENT DOCUMENTS

| | | | |
|---|---|---|---|
| CA | 963436 | | 2/1975 |
| CA | 965388 | | 4/1975 |
| CA | 1006450 | | 3/1977 |
| CA | 1192852 | | 9/1985 |
| CA | 2099763 | | 7/1992 |
| CH | 540159 | A | 8/1973 |
| CH | 653574 | | 1/1986 |
| CH | 688082 | A5 | 5/1997 |
| DE | 588631 | | 11/1933 |
| DE | 27 32 049 | | 1/1978 |
| DE | 2900998 | | 7/1980 |
| DE | 29 44 653 | A | 5/1981 |
| DE | 34 09 961 | A1 | 9/1985 |
| DE | 3439442 | | 4/1986 |
| DE | 35 17 122 | C | 5/1986 |
| DE | 4102326 | | 7/1992 |
| DE | 4209258 | A1 | 9/1993 |
| DE | 19618514 | A1 | 11/1997 |
| DE | 29905100 | U1 | 6/1999 |
| DE | 201 17 496 | U1 | 2/2002 |
| EP | 0 300 762 | | 1/1989 |
| EP | 0 536 344 | | 4/1993 |
| EP | 636548 | B1 | 2/1995 |
| EP | 0 678 334 | | 10/1995 |
| EP | 0 689 825 | A1 | 1/1996 |
| EP | 0 847 809 | A1 | 6/1998 |
| EP | 0 987 060 | A1 | 3/2000 |
| FR | 2 510 069 | | 1/1983 |
| FR | 2639324 | | 5/1990 |
| FR | 2 669 306 | | 5/1992 |
| GB | 653136 | | 5/1951 |
| GB | 969392 | | 9/1964 |
| GB | 1573514 | | 8/1980 |
| GB | 2103173 | | 2/1983 |
| GB | 2 170 471 | | 8/1986 |
| JP | 01 027659 | A | 1/1989 |
| JP | 64-27659 | | 1/1989 |
| JP | 6-335643 | | 12/1994 |
| JP | 08192851 | A | 7/1996 |
| JP | 10007170 | A | 1/1998 |
| JP | 11028394 | A | 2/1999 |
| JP | 2001252599 | | 9/2001 |
| SU | 1088812 | | 4/1984 |
| WO | WO 92/11930 | | 7/1992 |
| WO | WO 92/14437 | | 9/1992 |
| WO | WO 95/11170 | A1 | 4/1995 |
| WO | WO 98/32539 | A1 | 7/1998 |
| WO | WO 99/06301 | A1 | 2/1999 |
| WO | WO 99/50153 | A1 | 10/1999 |

* cited by examiner

CONFORMABLE POUCH RESERVOIR FOR SPRAY GUN

This application claims priority to United Kingdom Application No. 0210446.1, filed May 8, 2002.

FIELD

This invention concerns improvements in or relating to liquid spraying apparatus. The invention is especially concerned with an improved liquid reservoir for use with such liquid spraying apparatus. The invention has particular, but not exclusive, application to pre-packaged liquid reservoirs that can be used with spray guns.

BACKGROUND

Spray guns are widely used in vehicle body repair shops when re-spraying a vehicle that has been repaired following an accident. In the known spray guns, the liquid is contained in a reservoir attached to the gun from where it is fed to a spray nozzle. On emerging from the spray nozzle, the liquid is atomised and forms a spray with compressed air supplied to the nozzle. The liquid may be gravity fed or, more recently, pressure fed by an air bleed from the compressed air line to the reservoir.

One type of known reservoir consists of a rigid pot attached to the spray gun with a removable lid for filling the pot with the liquid to be sprayed onto the substrate. The reservoir is re-usable and both the spray gun and reservoir have to be thoroughly cleaned when changing the liquid in the reservoir to avoid cross-contamination which may adversely affect the finish. This is especially important when spraying part of a vehicle to match exactly the colour of the existing colour of the adjacent bodywork.

Cleaning the spray gun and reservoir is time consuming and often requires the use of solvents that are costly and may present a health hazard to the operator. In order to reduce the amount of cleaning and to facilitate changeover from one liquid to another, we have previously proposed in WO 98/32539 a reservoir in which a paint pot is provided with a disposable container received in the pot. The container comprises an open-topped liner that contains the liquid and a separate lid that closes the liner and has an outlet connectable to the spray gun.

In use the liner collapses as liquid is withdrawn from the container and, after spraying, the collapsed liner and lid can be removed and thrown away allowing a new, clean liner and lid to be used for applying a different liquid. As a result, the amount of cleaning required is considerably reduced and the spray gun can be readily adapted to apply different liquids in a simple manner. The liner, however, may collapse in a random, uncontrolled manner forming pockets in which liquid can be trapped. This can lead to some of the liquid being thrown away with the collapsed liner and lid which is wasteful.

The above-described reservoirs can be used with bulk liquids supplied ready for use such as solvents, lacquers and with liquids that are made-up on demand such as paints requiring matching of the colour to an existing paint finish. Transferring bulk liquids from a storage container is time consuming and can result in spillage which is wasteful and potentially dangerous where the liquid is flammable and/or gives of harmful vapours. Making up liquids on demand is also time consuming and can be wasteful where only a small volume of liquid is required for a given application.

SUMMARY

The present invention has been made from a consideration of the foregoing disadvantages of known reservoirs for spray guns and seeks to provide an improved reservoir whereby at least some of the disadvantages are avoided or mitigated with resulting benefits and advantages for the manufacturer and/or user.

Specifically, in certain embodiments, the present invention provides a reservoir for use with liquid spraying apparatus wherein the reservoir is collapsible in a controlled, reliable manner that permits substantially all of the liquid to be withdrawn from the reservoir.

As used herein, the term "liquid" refers to all forms of flowable materials that can be applied using a spray gun (whether or not they are intended to colour the surface) including (without limitation) paints, primers, base coats, lacquers, varnishes and similar paint-like materials as well as other materials such as adhesives, sealers, fillers, putties, powder coatings, blasting powders, abrasive slurries, mould release agents and foundry dressings which may be applied in atomised or non-atomised form depending on the properties and/or the intended application of the material and the term "liquid" is to be construed accordingly.

In certain embodiments, the present invention provides a collapsible reservoir that can be supplied pre-filled with liquid for attaching to the liquid spraying apparatus.

In certain embodiments, the present invention provides a pre-filled, collapsible reservoir of simple construction whereby manufacture and supply of the reservoir filled with liquid is facilitated.

In certain embodiments, the present invention provides a pre-filled, collapsible reservoir which can be stored safely until required.

In certain embodiments, the present invention provides a pre-filled, collapsible reservoir which can be fitted to and removed from a spray gun in a reliable manner and can be used to store unused liquid between spraying operations.

In certain embodiments, the present invention provides a pre-filled collapsible reservoir that can be thrown away after use.

In one aspect, the present invention provides a reservoir for use with liquid spraying apparatus, the reservoir having a substantially rigid first part for releasable connection to liquid spraying apparatus and having an opening through which liquid can be withdrawn for supply to the apparatus, and a flexible second part having an internal surface defining with an internal surface of the first part a chamber containing the liquid wherein the second part is arranged to reduce the volume of the chamber as the liquid is withdrawn from the chamber in use and to conform substantially to the internal surface of the first part in a collapsed condition of the reservoir.

By this invention, the reservoir is collapsible in a controlled manner that ensures substantially all the liquid contained in the reservoir can be delivered to the spraying apparatus if required. More particularly, the formation of pockets in which liquid is trapped as the reservoir collapses can be prevented by arranging that the flexible second part conforms substantially to the internal surface of the rigid first part.

For convenience, the invention will be described hereinafter with reference to use of the reservoir with a spray gun but it will be understood that the invention is not limited to such use and that the reservoir may be used with other types of liquid spraying apparatus.

Preferably, the reservoir is supplied pre-filled with liquid for attachment to the spray gun and, after use, the reservoir can be detached and thrown away. In this way, assembly and filling of the reservoir by the end user may be avoided and the spray gun can be adapted to apply any liquid by fitment of the appropriate reservoir after any necessary cleaning of the spray gun only. As a result, the amount of cleaning required is kept to a minimum and the spray gun can be easily set up to spray different liquids by replacing the reservoir quickly and easily with a minimum disruption.

The first and second parts may be formed separately and permanently united during manufacture to form the reservoir. For example, the first and second parts may be secured together by adhesive, heat sealing, ultrasonic welding or other suitable technique. Alternatively, the first and second parts may be formed integrally in one piece. For example, the first and second parts may be formed by injection or blow moulding with the second part being of reduced thickness.

Advantageously, the internal surface of the first part extends between an upper, apex end and a lower, base end that is wider than the apex end. The internal surface of the first part may be straight or curved or a combination thereof. For example, the internal surface may be of conical or part spherical shape. Preferably, the opening is at the upper, apex end for connecting the reservoir to the spray gun, and the flexible second part is at the lower, base end opposite the opening.

Preferably, the first part comprises a substantially rigid body and the flexible second part comprises a diaphragm arranged to deform into the body in response to withdrawal of liquid from the reservoir and conform substantially to the internal surface of the body in the collapsed condition. The body and/or diaphragm may be adapted to provide the reservoir with additional desirable properties or characteristics in use. For example, the reservoir may be adapted to exclude light or provide insulation.

In one arrangement, the second part comprises an elastic diaphragm of extensible material arranged to extend in a substantially flat condition across the lower, base end of the first part when the reservoir is filled with liquid. Suitable materials include elastomers such as rubber.

With this arrangement, the reservoir can stand in an upright position supported by the base end of the first part with the diaphragm concealed and protected by the first part when the reservoir is not in use. The wider, base end of the first part provides stability against tipping in the upright position and the diaphragm does not affect stability of the reservoir in this condition. As a result, the risk of accidental or inadvertent puncturing of the diaphragm is reduced when the reservoir is not in use.

In use, the diaphragm stretches and deforms inwardly towards the opening to reduce the volume of the chamber when liquid is withdrawn from the reservoir. In this way, the diaphragm progressively engages the internal surface from the wider base end towards the apex end until, in the fully collapsed condition of the reservoir, the diaphragm conforms to the shape of the internal surface of the first part. This prevents pockets being formed between the diaphragm and the internal surface in which liquid may be trapped. As a result, substantially all the liquid can be discharged in the fully collapsed condition of the reservoir.

In another arrangement, the second part comprises a reversible diaphragm of substantially inextensible material. Suitable materials include metal foils or polymer films or similar flexible sheet materials of single or multi-layer construction including laminates of one or more of these materials that are preferably puncture resistant and impermeable to the liquid contained in the reservoir.

Preferably, the diaphragm is of substantially the same shape as the internal surface of the first part. With this arrangement, the diaphragm extends away from the base end of the first part and is a mirror image of the internal surface of the first part when the reservoir is filled with liquid. As a result, for a first part of the same size and shape, the volume of the reservoir is approximately doubled compared to the previous arrangement. The apex end of the diaphragm may be flattened so that the reservoir can stand in an upright position when filled with liquid.

In use the diaphragm deforms inwardly to reduce the volume of the chamber as liquid is withdrawn from the reservoir. In this way, the diaphragm progressively engages the internal surface of the first part from the wider base end towards the apex end. In the fully collapsed condition of the reservoir, the diaphragm is reversed from its initial position and conforms substantially to the shape of the internal surface of the first part. This prevents pockets being formed between the diaphragm and the internal surface in which liquid may be trapped. As a result, substantially all the liquid can be discharged in the fully collapsed condition of the reservoir.

In both arrangements, the first part is preferably adapted to prevent the opening being completely closed-off by the diaphragm when liquid is withdrawn from the reservoir. For example, the first part may provide a path that allows the last of the liquid to be dispensed as the diaphragm collapses inwardly. In this way, substantially complete dispense of the liquid is assured. For example, the first part may be provided with one or more formations at the marginal edge of the opening to provide at least one aperture that remains open in the fully collapsed condition of the reservoir. The path may extend from the marginal edge of the opening towards the base end of the first part. For example, the internal surface of the first part may be provided with one or more raised ribs or recessed channels.

Advantageously, the opening in the first part is provided with a spout for connecting the reservoir to the spray gun in a fluid tight manner. For example, the reservoir may be detachably secured to an adapter attached to the spray gun. The reservoir and adapter may be provided with co-operating formations for releasably securing the reservoir. The formations may be engageable with a push/twist action to lock the reservoir in position. The formations may be released by a reverse action or by pulling the reservoir away from the spray gun. In this way, the reservoir can be connected to and released from the spray gun with a simple action requiring minimum effort and/or manual dexterity by the user.

Preferably, the first part has a size and shape that can be held by the user to attach and detach the reservoir without compressing the liquid in the reservoir. As a result, the integrity of the reservoir is not compromised when fitting the reservoir and the risk of spillage when removing the reservoir is reduced.

The reservoir may be filled with liquid introduced through the spout and the spout closed to seal the reservoir until the reservoir is to be fitted to the spray gun. For example, the spout may be closed by a rupturable membrane such as a foil cap. The user may pierce the membrane prior to attaching the reservoir to the spray gun. Alternatively, the membrane may be ruptured automatically when the reservoir is attached to the spray gun.

Preferably, the spout is provided with a separate detachable cap to protect the membrane from accidental or inadvertent rupturing prior to fitting the reservoir to the spray gun. The cap may be re-fitted to seal the spout when the reservoir is detached from the spray gun to prevent spillage or leakage of any liquid remaining in the reservoir. The reservoir may then be thrown away in a sealed condition for safe disposal of the contents or stored for later re-attachment to the spray gun to use the remaining liquid.

Alternatively, the spout may be provided with a manually operable valve to open and close the opening. The valve may be operable with the reservoir secured to the spray gun. In this way, the reservoir may be attached to the spray gun with the opening closed and the valve actuated to open the outlet and permit transfer of liquid to the spray gun. Similarly, when it is desired to remove the reservoir, the valve may be actuated to close the opening before detaching the reservoir. In this way, the risk of spillage or leakage of the contents of the reservoir is reduced. Moreover, any unused liquid can be stored in the reservoir for later use by re-attaching the reservoir to the spray gun. The provision of a valve forms the subject matter of our co-pending UK patent application of even date.

A filter may be provided to remove any unwanted solid particles from liquid withdrawn from the reservoir to the spray gun in use. For example, the filter may comprise a removable mesh screen fitted in the spout after filling the reservoir with the liquid and before closing the spout.

According to a second aspect of the present invention, there is provided liquid spraying apparatus in combination with a reservoir according to the first aspect of the invention.

The liquid spraying apparatus may be a spray gun. The spray gun may be of the gravity fed type in which a pressure differential is created across the flexible member as liquid is withdrawn from the reservoir causing the member to deform inwardly towards the opening. Alternatively, the spray gun may be of the pressure fed type in which the reservoir is arranged so that the flexible member is exposed to an increased air pressure externally of the reservoir by an air bleed from the compressed air supply line to the gun.

Other features, benefits and advantages of the invention will be understood from the following description of exemplary embodiments with reference to the accompanying drawings in which like reference numerals are used throughout to indicate corresponding parts.

DETAILED DESCRIPTION

Figure 1:
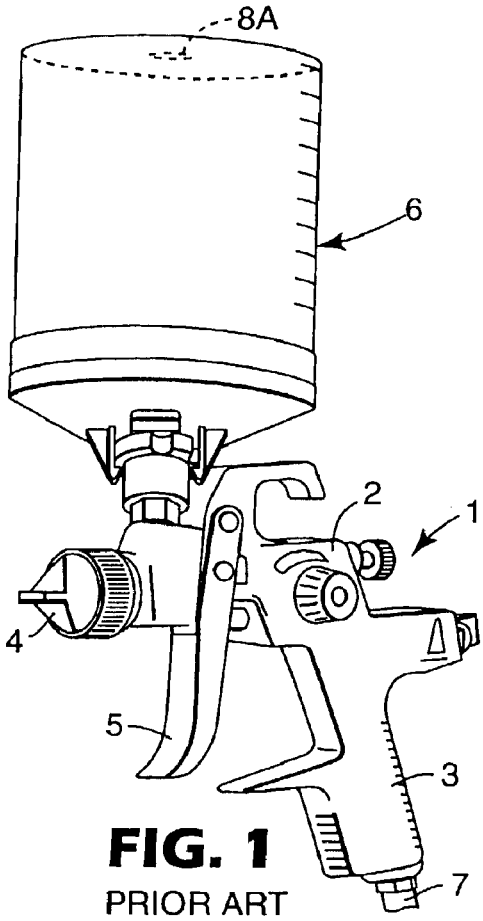
FIG. 1 PRIOR ART
FIG. 1 is a perspective view of a prior art spray gun.

FIG. 1 of the drawings illustrates a prior art paint spray gun 1 of the gravity-feed type disclosed in our co-pending patent application published under No: WO 98/32539 the contents of which are incorporated herein by reference.

The gun 1 comprises a body 2, a handle 3 which extends downwards from the rear end of the body, and a spray nozzle 4 at the front end of the body. The gun 1 is manually-operated by a trigger 5 which is pivotally-mounted on the sides of the gun.

A paint pot 6, which contains paint (or similar material) to be discharged by the gun, is located on the top of the body 2 and communicates with an internal passageway (not visible) which extends through the gun to the nozzle 4.

In use, the gun 1 is connected via a connector 7 at the lower end of the handle 3 to a source of compressed air (not shown) so that, when the user pulls on the trigger 5, compressed air is delivered through the gun to the nozzle 4. As a result, paint delivered under gravity from the pot 6 to the nozzle 4 is atomised on leaving the nozzle 4 and forms a spray with the compressed air emerging from the nozzle 4.

Figure 3:
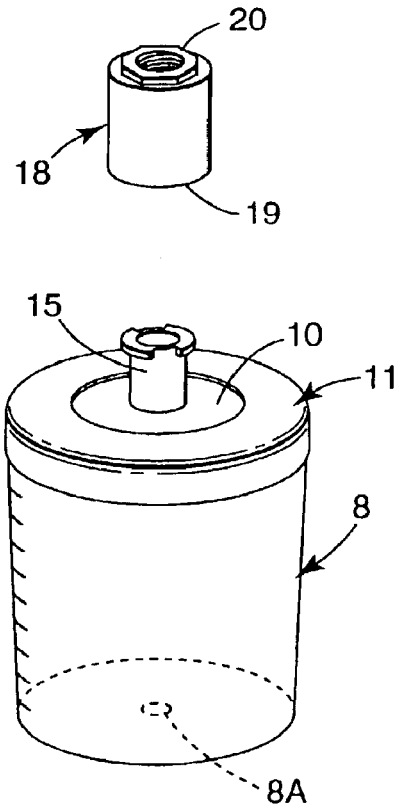
FIG. 3 PRIOR ART
FIG. 3 is a perspective view showing the paint reservoir of FIG. 2 assembled and an adapter for connecting the reservoir to the spray gun.
Figure 4:
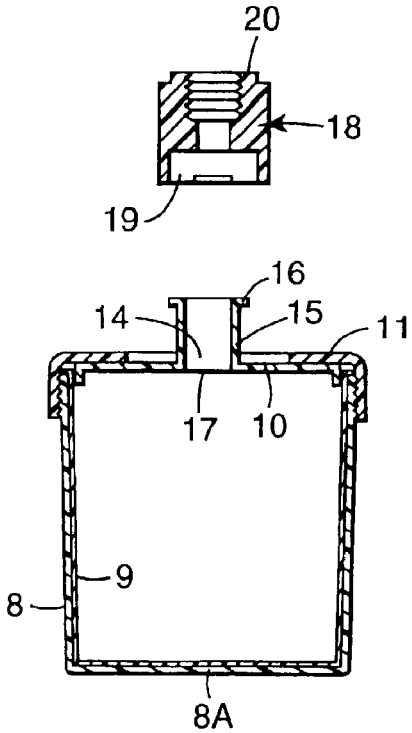
FIG. 4 PRIOR ART
FIG. 4 is a longitudinal section through the paint reservoir and adapter shown in FIG. 3.
Figure 2:
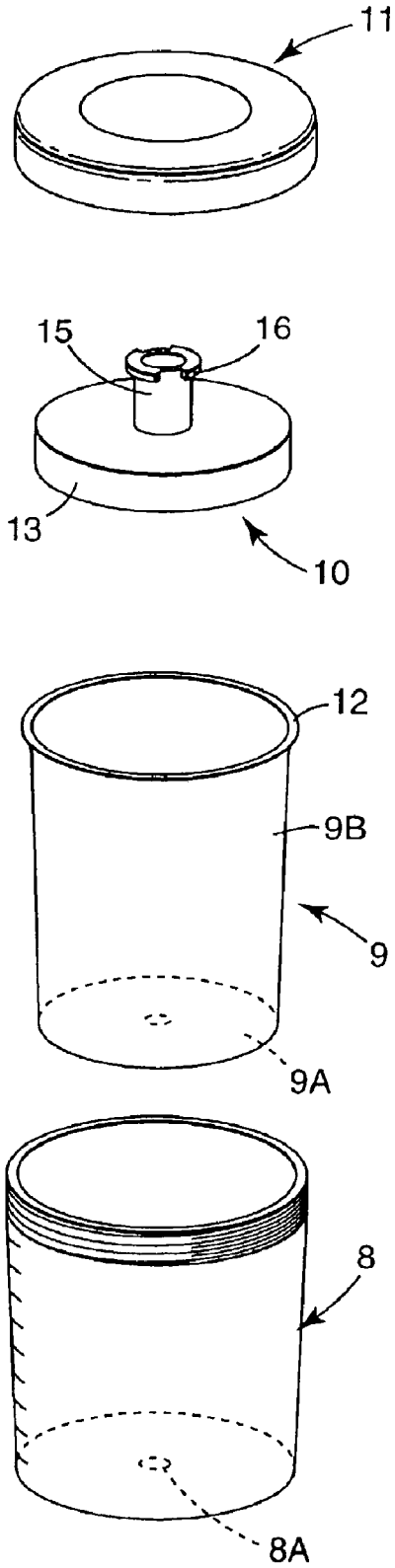
FIG. 2 PRIOR ART
FIG. 2 is an exploded isometric view of the component parts of the paint reservoir shown in FIG. 1.

Referring now to FIGS. 2 to 4 of the drawings, the paint pot 6 includes an outer container 8, a disposable liner 9, a disposable lid 10 and a collar 11. The liner 9 corresponds in shape to (and is a close fit in) the interior of the container 8 and has a narrow rim 12 at the open end which sits on the top edge of the container 8.

The lid 10 has a dependent skirt 13 at the peripheral edge which is a push-fit in the open end of the liner 9 and a central aperture 14 from which extends a connector tube 15 forming a fluid outlet. The tube 15 is provided at its free end with outward extensions 16 forming one part of a bayonet connection. The aperture 14 is covered by a filter mesh 17 which may be a push fit into the aperture 14 or may be an integral part of the lid 10.

The lid 10 is held firmly in place on the container 8 by the annular collar 11 that screws onto the container 8 on top of the lid 10. In the assembled condition, the liner 9 and lid 10 form a reservoir for containing the paint or other liquid to be delivered to the nozzle 4 via the connector tube 15.

The paint pot 6 is attached to the spray gun 1 through use of an adapter 18 which is formed internally at one end 19 with the other part of the bayonet connection for attachment to the connector tube 15 of the lid 10. At the other end 20, the adapter 18 is shaped to match the standard attachment of the spray gun paint pot (typically a screw thread).

To use the paint pot 6, the adapter 18 is attached at the end 20 to the spray gun and is left in position. Then, with the paint pot 6 disassembled as shown in FIG. 2, the liner 9 is pushed inside the container 8. Paint is then put into the liner 9 and, if necessary, mixed with other tinters, hardeners and thinners (solvents). The lid 10 is then pushed into place and the collar 11 is screwed down tightly to hold the lid 10 in position.

The spray gun 1 is then inverted from its normal operating position illustrated in FIG. 1 so that the paint pot 6 can be presented to the spray gun 1 in an upright position to prevent spillage of paint. The end of the connector tube 15 is then attached to the adapter 18 to secure releasably the paint pot 6 to the spray gun 1. The spray gun 1 can then be returned to its normal operating position for use in the usual way.

In use, as paint is withdrawn from the reservoir, the liner 9 collapses in an axial direction from base end 9A towards the lid 10. A vent hole 8A in the base end of the container 8 allows air to enter the container 8 as the liner 9 collapses. Sidewall 9B of the liner 9 folds inwardly in a random, uncontrolled manner as the liner 9 collapses. This can result in pockets being formed that trap and retain paint within the liner 9 and prevent all of the paint being transferred to the spray gun 1.

After use, when the spray gun 1 is to be cleaned, the spray gun 1 can be re-inverted from its operating position shown in FIG. 1, the airline disconnected and the trigger 5 actuated briefly to allow paint within the spray gun 1 to drain back into the liner 9 in the pot 6. The pot 6 is then removed from the spray gun 1 by detaching the connector tube 15 from the adapter 18 which remains on the spray gun 1.

The collar 11 is removed from the container 8, and the lid 10 is then pulled out, bringing with it the collapsed liner 9, leaving the container 8 and collar 11 clean and ready for re-use with a fresh liner 9 and lid 10. Only the spray gun 1 itself needs to be cleaned, resulting in a substantial reduction in the amount of solvent used.

Any paint remaining in the liner 9 may be stored for a short period of time by sealing the connector tube 15, for example with a detachable closure cap (not shown). The lid/liner assembly can then be re-assembled with the container 8 and collar 11 and re-attached to the spray gun 1 to use the remaining paint.

When removed from the container 8, the lid/liner assembly is relatively fragile and susceptible to separation of the liner 9 and lid 10 if mishandled. Accordingly, it is generally only practical to store unused paint for a few hours and any unused paint must be decanted into another container if long term storage is required. When all the paint has been used or if any remaining paint is no longer required, the lid 10 (including the filter 17) and collapsed liner 9 can be discarded.

The arrangement of the disposable liner 9 and separate, disposable lid 10 to form a reservoir to contain the paint or other liquid to be sprayed considerably reduces the amount of cleaning required when changing the liquid to be sprayed or when putting the spray gun 1 away at the end of the working day. This is a considerable improvement over arrangements where both the spray gun and the reservoir have to be cleaned and provides many benefits for the user.

It will be apparent, however, that assembly of the reservoir and its fitment to and removal from the spray gun can be time consuming to ensure the various components are correctly assembled for proper functioning and to reduce the risk of leakage.

Figure 5:
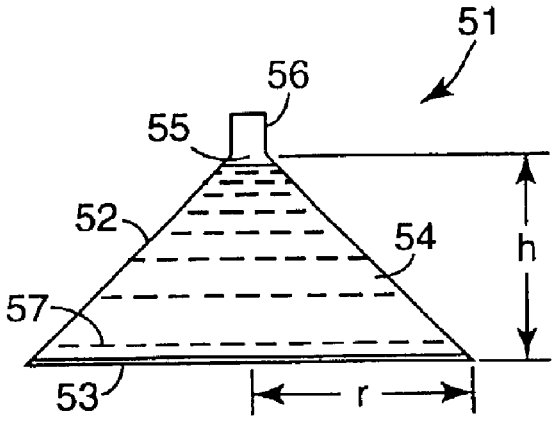
FIG. 5 is a side view of a first embodiment of a paint reservoir for use with a spray gun according to the present invention, the reservoir being shown in its pre-filled condition for fitment to the spray gun.
Figure 6:
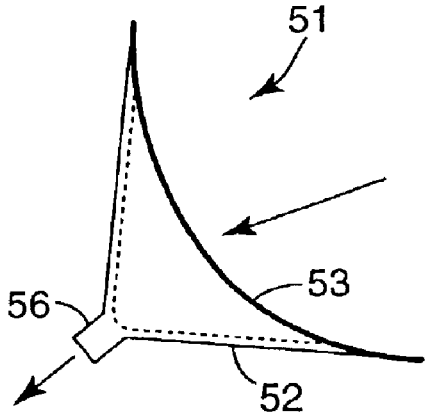
FIG. 6 is a diagrammatic side view, similar to FIG. 5, showing the change in shape of the reservoir as the contents are discharged.
Figure 7:
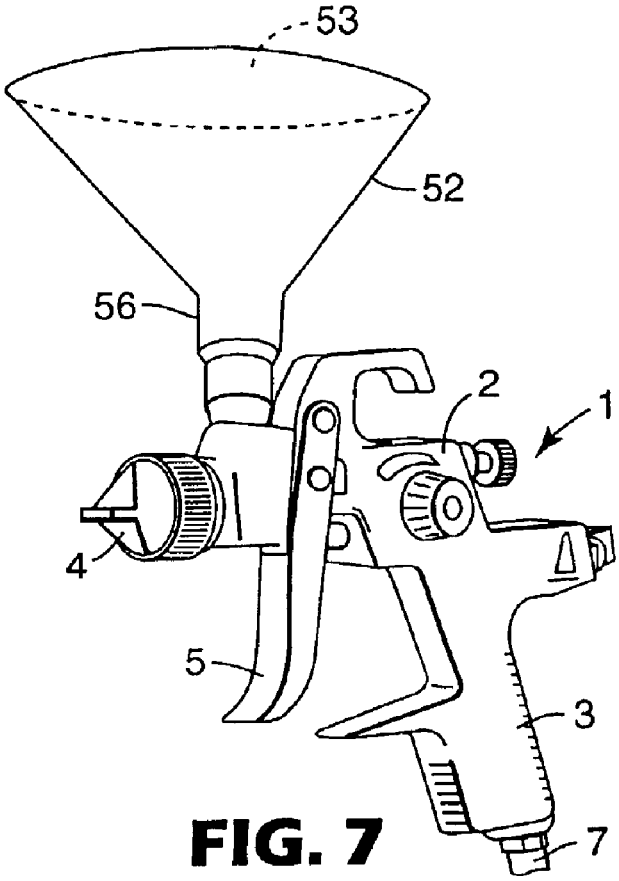
FIG. 7 is a perspective view showing the reservoir of FIGS. 5 and 6 attached to the spray gun of FIG. 1.

Referring now to FIGS. 5 to 7 of the drawings, there is shown a first embodiment of a disposable, pre-filled reservoir according to the present invention that can be fitted to the spray gun in a simple manner. The reservoir is particularly suitable for manufacture and supply of a liquid that does not require accurate matching of the colour such as primers, lacquers, solvents.

As shown, the reservoir 51 has a rigid body 52 of conical shape closed at the wider base end by an extensible, flexible diaphragm 53 that defines with the body 52 a chamber 54. The body 52 is provided with an opening 55 at the apex end opposite the diaphragm 53 that leads to a spout 56 formed integrally with the body 52.

The body 52 and diaphragm 53 are made of materials compatible with the liquid 57 contained in the reservoir 51. In this embodiment, the body 52 is made of a plastic material such as polyethylene terepthalate (PET) or polyamide by injection moulding. The diaphragm 53 is made of an elastic material such as rubber or similar elastomer bonded to the body 52 by any suitable method, for example adhesive, heat sealing or ultrasonic welding.

The reservoir 51 may be opaque if the liquid 57 is light sensitive. Alternatively, if the liquid 57 is light stable, the body 52 may be transparent or translucent to allow visual inspection of the liquid 57 in the reservoir 51. The body 52 may also be provided with scale markings to indicate the volume of liquid 57 in the reservoir 51.

The reservoir 51 is pre-filled with liquid 57 introduced through the spout 56 and the spout 56 closed to seal the reservoir 51 by attaching a rupturable membrane such as a foil cap (not shown) across the outer end. Alternatively, the spout may be closed by any other suitable means such as a screw cap, bung or ring pull. A filter (not shown) may be located in the spout 56 after filling the reservoir 51 to remove any solid particles when the liquid 57 is dispensed in use of the reservoir 51.

The volume of the reservoir 51 is determined by the dimensions of the body 52 using the formula $V=\frac{1}{3}\Pi r^2 h$ where r is the radius of the base end of the body 52 and h is the height of the body 52. For example, a radius of 5 cm and a height of 2.5 cm produces a volume of 65 cc. As will be appreciated, the reservoir 51 can be constructed to provide any desired volume by altering the dimensions of the body 52.

Thus, the body 52 may be constructed to provide a reservoir 51 capable of holding sufficient liquid 57 for a single application or for multiple applications. The reservoir 51 may be substantially completely filled with the liquid 57 or slightly underfilled to allow the liquid 57 to be thoroughly mixed prior to use by shaking the reservoir 51 by hand or machine, possibly aided by an internal mixing bearing. This may be advantageous and/or desirable where the reservoir 51 has been stored for some time before use.

The diaphragm 53 forms a substantially flat base when the reservoir 51 is filled with the liquid 57. In this way, the reservoir 51 is free-standing and can be stood upright on the base supported by the wider base end of the rigid body 52. This provides a particularly stable arrangement for supply and storage of the pre-filled reservoir 51 and reduces the risk of accidental or inadvertent puncturing of the diaphragm 53.

The spout 56 is provided with bayonet formations (not shown) compatible with the bayonet formations of the adapter 18 (FIGS. 3 and 4) by means of which the reservoir 51 can be releasably connected to the spray gun 1 (FIG. 1) as described previously. It will be understood, however, that any other suitable method of releasably connecting the reservoir 51 may be employed, for example screw fit, compression fit or locking collar.

Prior to attaching the reservoir 51, the rupturable membrane closing the spout 56 is pierced or removed. Alternatively, the membrane may be pierced automatically when the reservoir 51 is connected to the spray gun 1.

The rigid body 52 is of size and shape that the user can grip the base end both when attaching the reservoir 51 to and when detaching the reservoir 51 from the spray gun 1. In this way, the liquid 57 in the reservoir 51 is not compressed when attaching/detaching the reservoir 51 thereby reducing the risk of leaks/spillage.

In use of the spray gun 1, as the liquid 57 is withdrawn from the reservoir 51 via the spout 56, a pressure differential is created across the diaphragm 53 causing it to stretch and deform inwardly towards the spout 56 as shown in FIG. 6. This allows a smooth uninterrupted flow of liquid 57 from the reservoir 51 by preventing formation of a vacuum within the reservoir 51. In addition, the diaphragm 53 is sufficiently elastic to stretch and progressively engage the internal surface of the rigid body 52 in a controlled manner as the liquid 57 is being withdrawn.

In the fully collapsed condition shown in dotted outline in FIG. 6, the diaphragm 53 conforms substantially to the internal shape of the rigid body 52. This assists in preventing formation of any pockets within the reservoir 51 that could trap the liquid 57 thereby ensuring substantially all the liquid 57 can be dispensed if required. Afterwards, the diaphragm 53 can return to its original shape when spraying is stopped.

Figure 22:
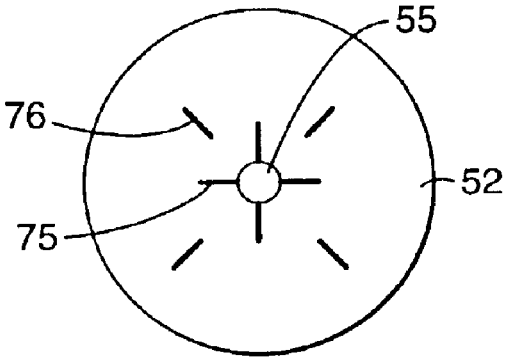
FIGS. 22 to 24 are schematic views of formations to keep the outlet from the reservoir open in the collapsed condition.
Figure 23:
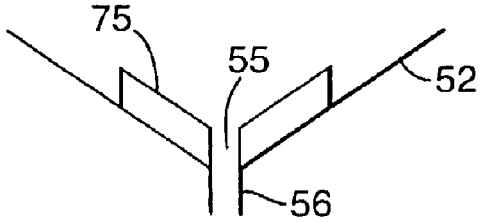

In a modification, the body 52 may be adapted to prevent the opening 55 being closed-off by the diaphragm 53 when liquid is withdrawn from the reservoir 51 so that the last of the liquid can be dispensed. For example, as shown in FIGS. 22 and 23, the body 52 may be provided with protruding ribs 75 radially disposed around the opening 55 and additional protruding ribs 76 disposed between and radially outwardly of the ribs 75. The ribs 75, 76 provide flow channels for liquid to flow to the opening 55 from anywhere in the reservoir 51. In this way, the ribs 75, 76 allow the last of the liquid to be dispensed and prevent the opening 55 being closed-off as the diaphragm 53 collapses inwardly towards the opening 55. The number, shape and position of the ribs 75, 76 may be altered from that shown to provide any desired flow channels for the liquid to reach the opening 55.

Figure 24:
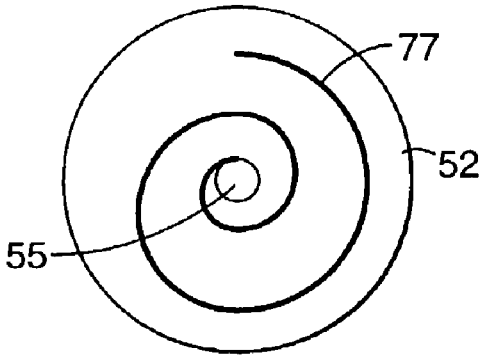

Alternatively, as shown in FIG. 24, the body 52 may be provided with a spiral flow channel 77 extending from the wider base end to the opening 55. In this way, the channel 77 provides a path for the last of the liquid to be dispensed and prevents the opening 55 being closed-off as the diaphragm 53 collapses inwardly towards the opening 55. The shape and position of the channel 77 may be varied and more than one channel 77 may be provided to allow the liquid to reach the opening 55 from any part of the reservoir 51.

It will be understood, that any other suitable arrangement may be provided to ensure that a path is kept open for the last of the liquid to be dispensed.

A detachable closure cap (not shown) may be provided for securing to the spout 56 to prevent accidental or inadvertent piercing of the rupturable membrane before use of the reservoir 51 and/or to allow the reservoir 51 to be re-sealed if removed from the spray gun 1 before all of the liquid 57 has been dispensed. In this way, any unused liquid can be stored in the reservoir 51 and the reservoir 51 later re-attached to the spray gun 1 for further use. The unitary construction of the reservoir 51 with the diaphragm 53 bonded to the body 52 is robust and permits long term storage of the unused paint in the reservoir 51 without risk of spillage or leakage.

Figure 8:
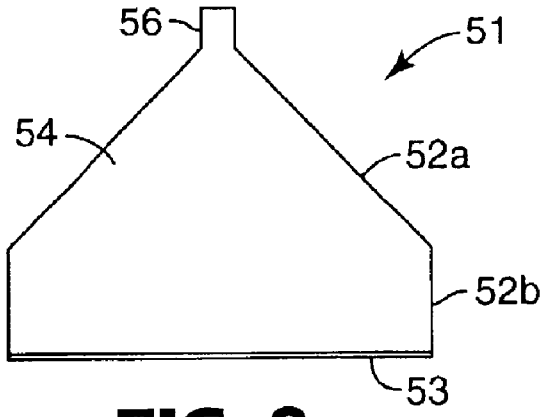
FIG. 8 shows a modification to the reservoir of FIGS. 5 to 7.
Figure 9:
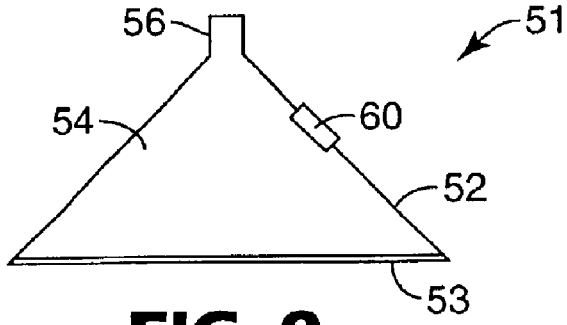
FIG. 9 shows another modification to the reservoir of FIGS. 5 to 7.
Figure 10:
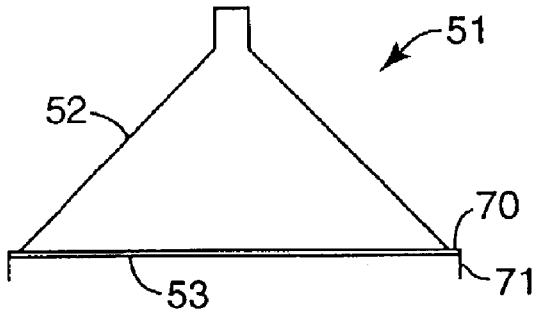
FIG. 10 shows yet another modification to the reservoir of FIGS. 5 to 7.

Various modifications to the reservoir 51 above-described are shown in FIGS. 8 to 10 in which like reference numerals are used to indicate corresponding parts.

In FIG. 8, an alternative shape of reservoir 51 is shown in which the rigid body 52 has a conical upper portion 52*a* and a cylindrical lower portion 52*b* with the diaphragm 53 secured to the base end of the lower portion 52*b*. This shape of body 52 is again free-standing and enables the volume of the reservoir 51 to be increased without increasing the radius of the conical portion 52*a* while still allowing the diaphragm 53 to deflect into the body 52 as liquid is withdrawn from the reservoir 51. This may be desirable where a conical portion of much larger radius could make the spray gun 1 unstable and difficult to use. Other shapes of reservoir that could be employed with a free-standing body 52 and diaphragm 53 will be apparent to those skilled in the art.

In FIG. 9, the reservoir 51 is shown with a plug 60 of self-sealing elastomeric material in the wall of the rigid body 52. The plug 60 allows addition of a liquid to the liquid 57 in the reservoir 51 by means of a syringe. This may be desirable where the two liquids have to be mixed immediately prior to use, for example the addition of hardeners or activators to a base liquid. Alternatively, the added liquid may be employed to modify the characteristics of a base liquid in the reservoir, for example the addition of tinters to alter the colour (shade) of a base coat or thinners (solvent) to alter the viscosity of a finishing clearcoat such as lacquer for "fading out" or "blending".

In FIG. 10, the reservoir 51 is shown with an internal shoulder 70 leading to an annular rim 71 at the base end. The diaphragm 53 is secured to the shoulder 70 and the rim 71 provides a support base for the reservoir 51. The rim 71 may be continuous or a series of discrete projections spaced apart around the base end. In this way, the reservoir 51 can be stood upright on a surface with the diaphragm 53 spaced above the surface to improve stability of the reservoir 51 and reduce further the risk of accidental or inadvertent puncturing of the diaphragm 53.

In a further modification, not shown, we may provide a base cap that fits over the base end of the reservoir 51 to protect the diaphragm 53 when the reservoir 51 is not in use. The base cap may be removable when the reservoir 51 is attached to the spray gun 1 to expose the diaphragm 53 to atmospheric pressure externally of the reservoir 51. Alternatively, the base cap may be provided with at least one hole to expose the diaphragm 53 to atmospheric pressure. In a still further modification (not shown) for use of the reservoir with a pressure fed spray gun, the hole may allow attachment of an air bleed from the compressed air supply line to the spray gun to expose the diaphragm to a positive pressure higher than atmospheric pressure.

Figure 11:
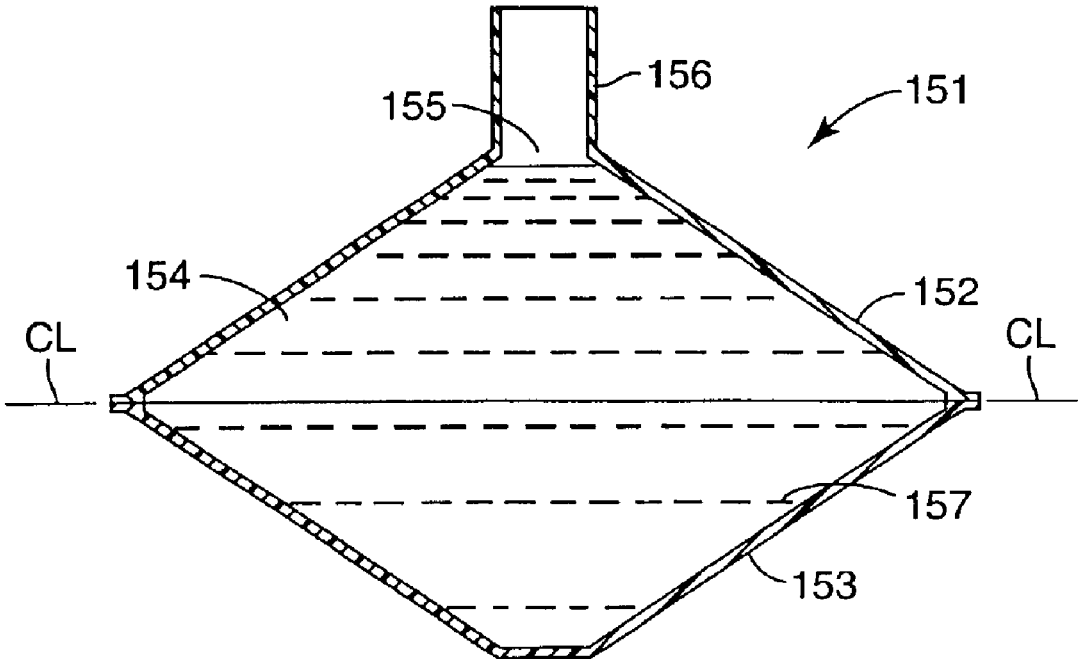
FIG. 11 is a longitudinal section of a second embodiment of a paint reservoir according to the present invention, the reservoir being shown in its pre-filled condition for attachment to the spray gun.
Figure 12:
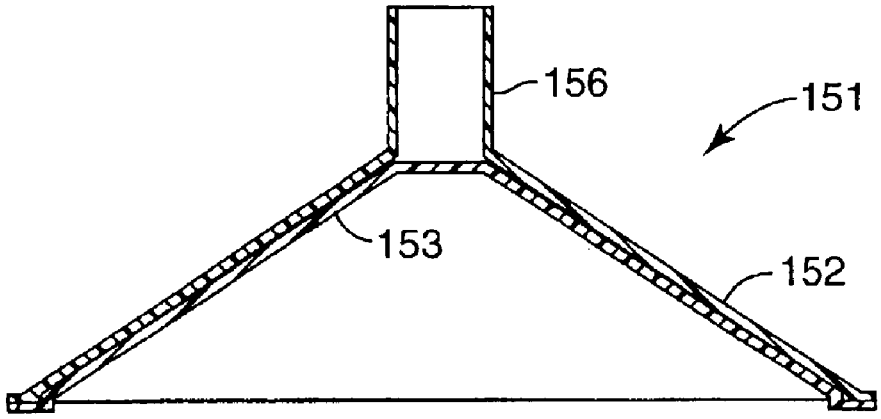
FIG. 12 is a longitudinal section similar to FIG. 11 showing the reservoir in its collapsed condition.

Referring now to FIGS. 11 and 12 of the drawings, there is shown a second embodiment of a disposable, pre-filled reservoir according to the present invention that can be fitted to the spray gun in a simple manner. Similar to the previous embodiment, this reservoir is particularly suitable for manufacture and supply of a liquid that does not require accurate matching of the colour such as primers, lacquers, solvents. For convenience, like reference numerals in the series 100 are used to indicate parts of the second embodiment corresponding to the first embodiment.

The reservoir 151 is shown in its extended or filled condition in FIG. 11 and in its collapsed or empty condition in FIG. 12. The reservoir 151 has a rigid body 152 of conical shape and an inextensible, flexible diaphragm 153 also of conical shape that define a chamber 154.

The body 152 is provided with an opening 155 at the apex end that leads to a spout 156 formed integrally with the body 152. The reservoir 151 may be opaque if the liquid 157 contained therein is light sensitive. Alternatively, if the liquid 157 is light stable, the body 152 and/or diaphragm 153 may be transparent or translucent to allow visual inspection of the liquid 157 in the reservoir 151. The reservoir 151 may also be provided with scale markings to indicate the volume of liquid 157 in the reservoir 151.

The body 152 and diaphragm 153 are made of materials compatible with the liquid 157 contained in the reservoir 151. In this embodiment, the body 152 is made of a plastic material such as polyethylene terepthalate (PET) or polyamide by injection moulding. The diaphragm 153 is made of an inelastic material and may be formed separately from the body 152 and bonded to the body 152 by any suitable method, for example adhesive, heat sealing or ultrasonic welding. Suitable materials for this can include metal foils and polymer films which may be of single or multi-layer construction and may include laminates of metal foils and polymer films. Alternatively, the diaphragm 153 may be formed integrally with the body 152. Suitable materials for this include plastics which may be the same or different to the plastic material of the body 152.

The reservoir 151 is pre-filled with liquid 157 introduced through the spout 156 and the spout 156 closed to seal the reservoir 151 by attaching a rupturable membrane such as a foil strip (not shown) across the outer end. A filter (not shown) may be employed to remove any solid particles from the liquid 157 during filling. Alternatively or additionally, a filter (not shown) may be located in the spout 156 after filling the reservoir 151 to remove any solid particles when the liquid 157 is dispensed in use of the reservoir 151.

The conical shape of the diaphragm 153 generally corresponds to the internal conical shape of the body 152. As shown, the apex end of the body 152 is truncated where the spout 156 is connected. The diaphragm 153 has a similar truncated apex end that forms a substantially flat surface 158 by means of which the reservoir 151 can be stood upright when filled with liquid 157 if desired.

In the extended position shown in FIG. 11, the internal surface of the chamber 154 is approximately symmetrical about a centre line CL where the base end of the body 152 is joined to the base end of the diaphragm 153. In this way, for a given height and radius of the body 152, the volume of the chamber 154 is substantially doubled compared to the first embodiment shown in FIGS. 5 to 7.

The reservoir 151 may hold sufficient liquid 157 for a single application or for multiple applications. The reservoir 151 may be substantially completely filled with the liquid 157 or slightly underfilled to allow the liquid 157 to be thoroughly mixed prior to use by massaging the diaphragm 153 or by shaking the reservoir 151 by hand or machine, possibly aided by an internal mixing bearing. This may be advantageous and/or desirable where the reservoir 151 has been stored for some time before use.

The spout 156 is provided with bayonet formations (not shown) compatible with the bayonet formations of the adapter 18 (FIGS. 3 and 4) by means of which the reservoir 151 can be connected to the spray gun 1 (FIG. 1). Prior to attaching the reservoir 151, the rupturable membrane closing the spout 156 is pierced or removed. Alternatively, the membrane may be pierced automatically when the reservoir 151 is connected to the spray gun 1. The rigid body 152 is again of a size and shape that the user can grip the base end both when attaching the reservoir 151 to and when detaching the reservoir 151 from the spray gun 1. In this way, the liquid 157 in the reservoir 151 is not compressed when attaching/detaching the reservoir 151 thereby reducing the risk of leaks/spillage.

In use of the spray gun 1, as the liquid 157 is withdrawn from the reservoir 151 via the spout 156, a pressure differential is created across the diaphragm 153 causing it to deform inwardly towards the spout 156 as shown in outline in FIG. 12. This allows a smooth uninterrupted flow of liquid 157 from the reservoir 151 by preventing formation of a vacuum within the reservoir 151. In addition, the diaphragm 153 is sufficiently pliable to progressively engage the internal surface of the rigid body 152 as the liquid 157 is being withdrawn. In the fully collapsed condition shown in FIG. 12, the diaphragm 153 is reversed from its original position and conforms substantially to the internal shape of the rigid body 152. This assists in preventing formation of any pockets within the reservoir 151 that could trap the liquid 157 thereby ensuring substantially all the liquid 157 can be dispensed if required. The body 152 may be adapted as described previously to provide a path that prevents the opening 155 being completely closed-off and allow the last of the liquid to be dispensed as the diaphragm 153 collapses.

A detachable closure cap (not shown) may be provided for securing to the spout 156 to prevent accidental or inadvertent piercing of the rupturable membrane before use of the reservoir 151. Alternatively or additionally, the closure cap may allow the reservoir 151 to be re-sealed if removed from the spray gun 1 before all of the liquid 157 has been dispensed. In this way, any unused liquid can be stored in the reservoir 151 and the reservoir 151 later re-attached to the spray gun 1 for further use. Again the unitary construction of the reservoir 151 facilitates long term storage of any unused paint in a safe manner.

Figure 13:
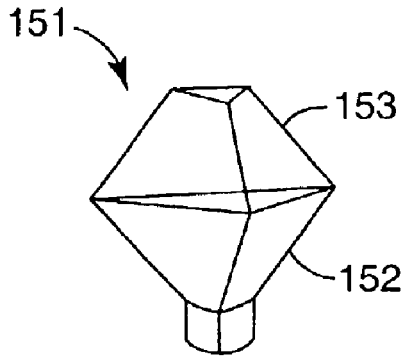
FIG. 13 shows a modification to the reservoir of FIG. 11.
Figure 14:
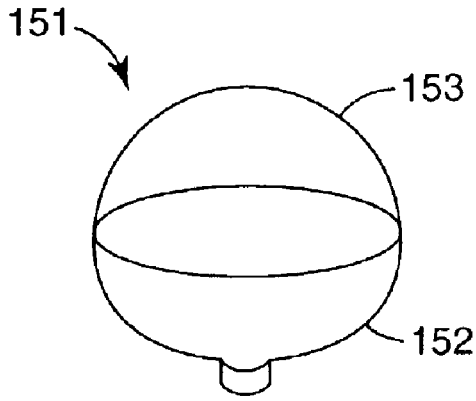
FIG. 14 shows another modification to the reservoir of FIG. 11.
Figure 15:
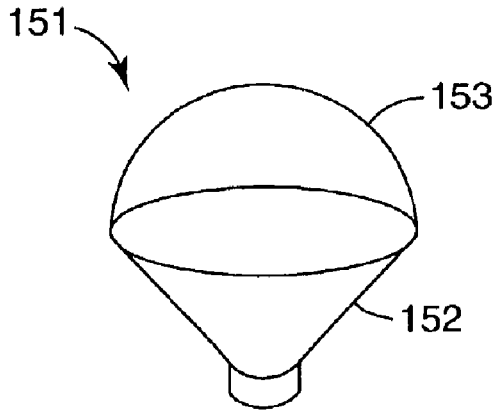
FIG. 15 shows yet another modification to the reservoir of FIG. 11.

Various modifications to the shape of reservoir 151 above-described are shown in FIGS. 13 to 15 in which like reference numerals are used to indicate corresponding parts.

In FIG. 13, the internal surface of the rigid body 152 and reversible diaphragm 153 are of truncated tetrahedral shape. Other truncated shapes with multiple flat sides such as pyramidal may be employed.

In FIG. 14, the internal surface of the rigid body 152 and reversible diaphragm 153 are of hemispherical shape. The hemispherical shape can usefully be employed to increase significantly the volume of the reservoir 151 for a given radius compared to the conical shape of FIG. 11. The diaphragm 153 may be provided with a flat base surface for standing the reservoir 151 upright if desired.

In FIG. 15, the internal surface of the rigid body 152 is of truncated conical shape and the reversible diaphragm 153 is of hemispherical shape. The hemispherical shape of the diaphragm 153 increases the volume of the reservoir 151 and is sufficiently similar to the internal shape of the rigid body 152 to allow the diaphragm 153 to conform to the internal surface of the rigid body 152 in the collapsed condition.

Other shapes that could be employed whereby the diaphragm 153 conforms substantially to the internal shape of the rigid body 152 in the collapsed condition will be apparent to those skilled in the art.

With reference now to FIGS. 16 to 19 of the drawings, a third embodiment of a collapsible, pre-filled reservoir according to the present invention is shown in which a valve device is provided for controlling flow of paint from the reservoir.

The construction and operation of the reservoir is similar to the second embodiment and will be understood from the description of the second embodiment. For convenience like reference numerals in the series 200 are used to indicate parts of the third embodiment corresponding to the second embodiment In this embodiment, the spout 256 is provided with a valve device 280 for controlling flow of paint from the reservoir 251. The valve device 280 is shown closed in FIG. 16 to seal the reservoir 251 and open in FIG. 17 to allow paint to be withdrawn from the reservoir 251.

The spout 256 is formed at the outer end with a series of circumferentially spaced internal webs or spurs 281 that meet at a central plug 282. The plug 282 is cylindrical and projects above the horizontal plane through from the end of the spout 256. In this embodiment, there are six webs 281 (two only shown) uniformly spaced in the circumferential direction and defining with the plug 282 six ports 305 through which paint can flow in the open condition of the valve device 280.

The valve device 280 includes an outer sleeve 283 slidably mounted on the spout 256. The sleeve 283 has an internal wall 284 at the upper end formed with a central opening 285 aligned with the plug 282. The plug 282 is a close fit in the opening 285 in the closed condition of the valve device 280 shown in FIG. 16 in which the wall 284 closes the ports 305 between the plug 282 and webs 281. In this position, the wall 284 prevents flow of paint from the reservoir 251.

Figure 17:
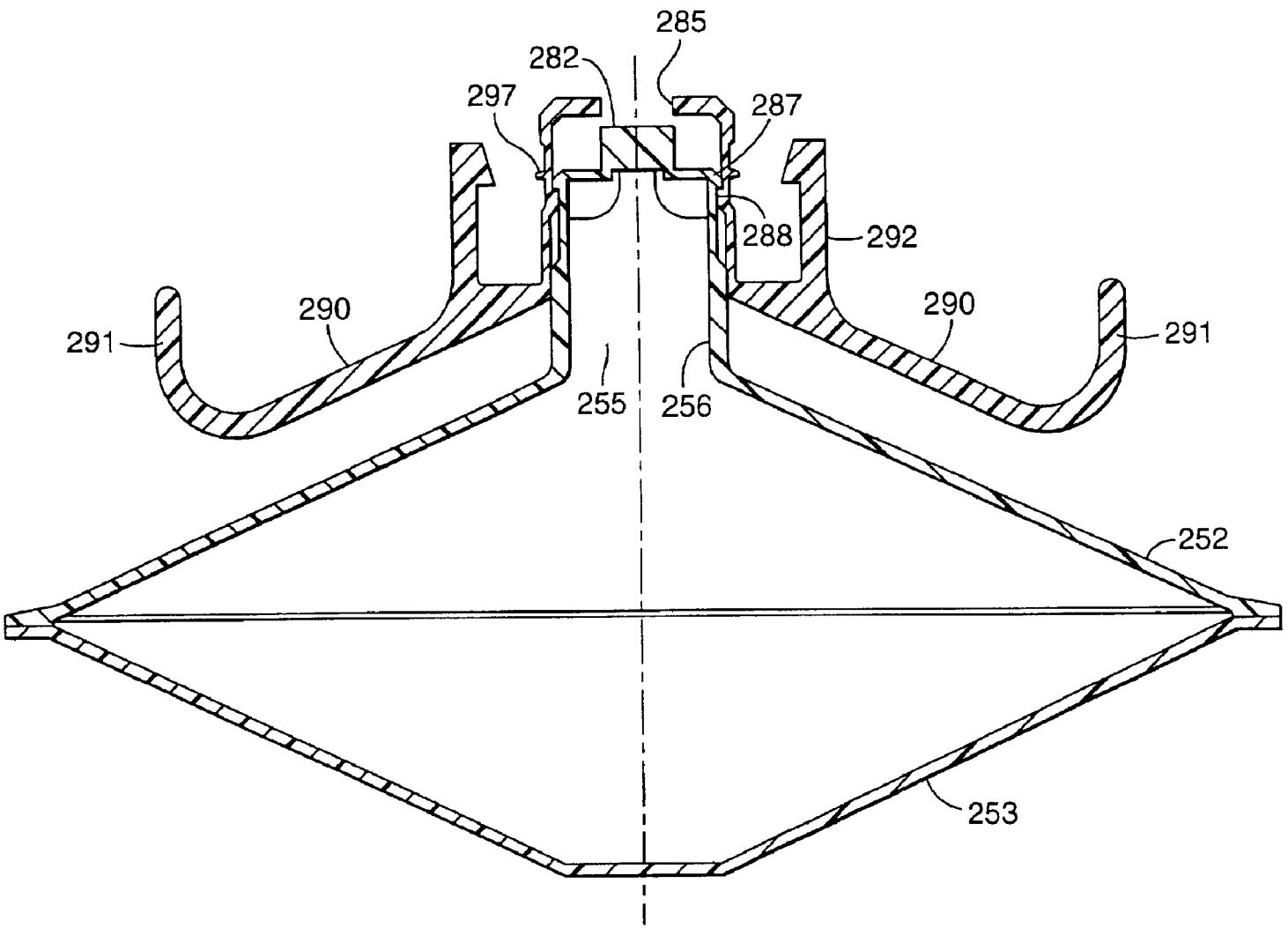
FIG. 17 is a view similar to FIG. 16 showing the valve device open.
Figure 18:
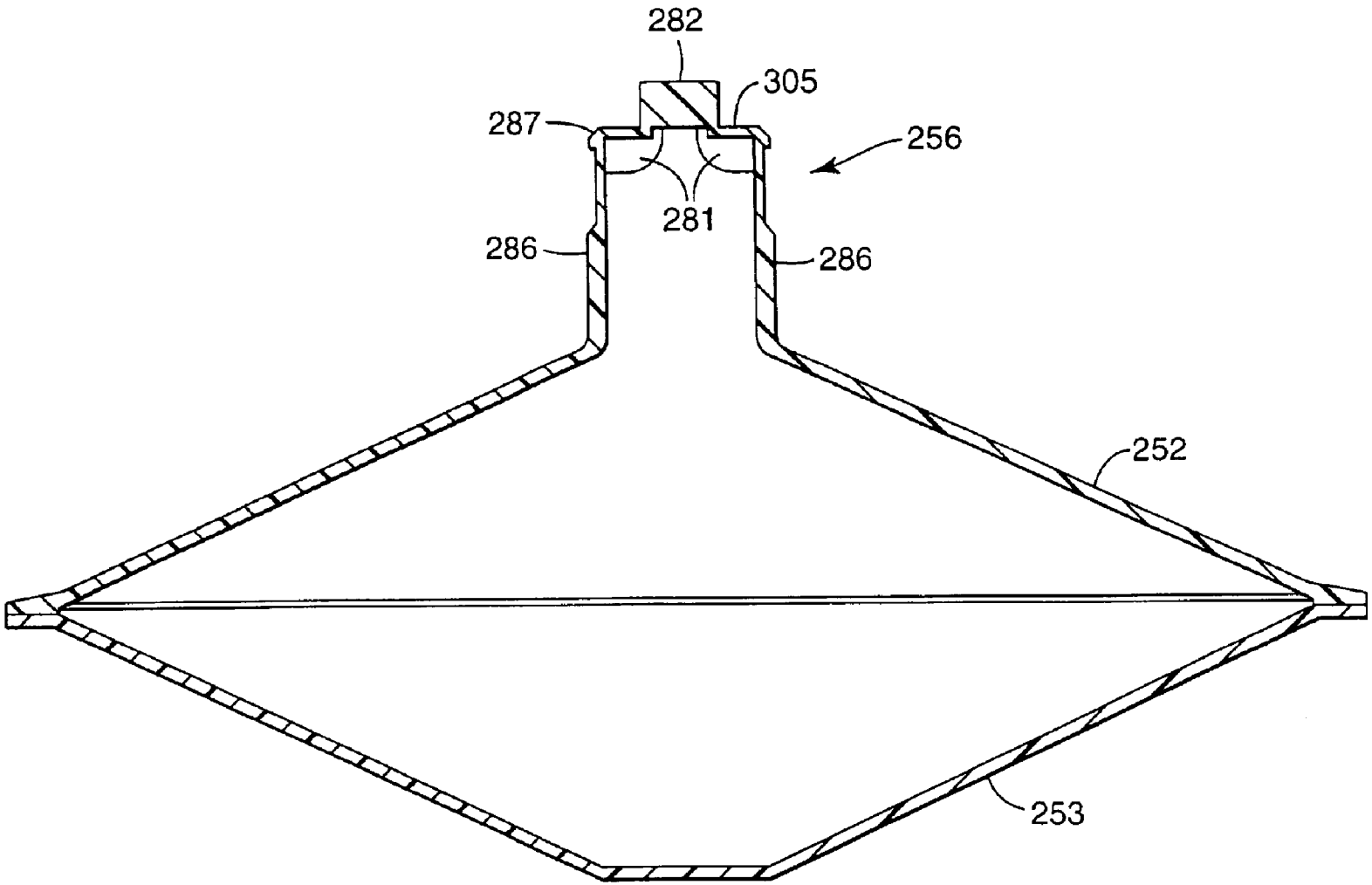
FIG. 18 is a longitudinal section through the reservoir shown in FIGS. 16 and 17 with the outer sleeve of the valve device removed.
Figure 19:
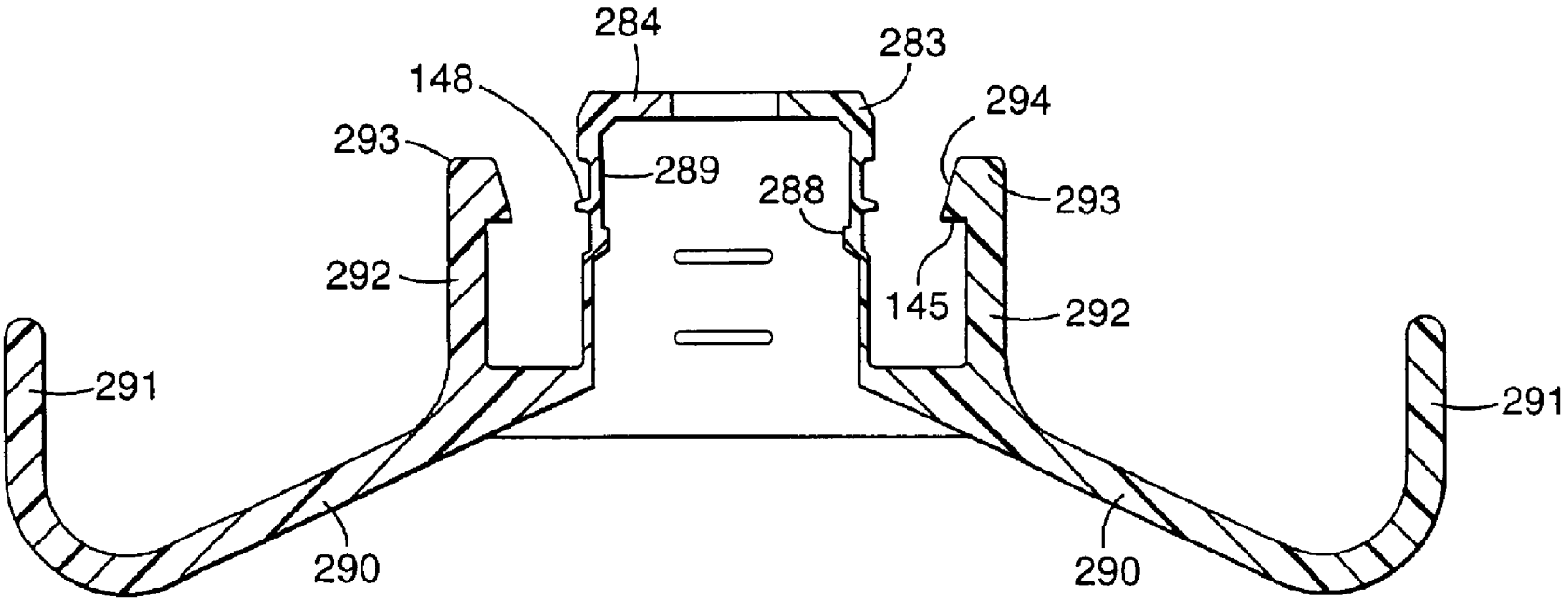
FIG. 19 is a longitudinal section through the outer sleeve of the valve device shown in FIGS. 16 and 17.

The sleeve 283 is axially slidable on the spout 256 to a position in which the central opening 285 of the wall 284 is clear of the plug 282 as shown in FIG. 17. In this position, the valve device 280 is open and paint can flow out of the reservoir 251 via the ports and central opening 285.

The sleeve 283 is prevented from rotating on the spout 256 by engagement of two diametrically opposed axially extending ribs 286 on the outer surface of the spout 256 in complementary axially aligned grooves (not shown) in the inner surface of the sleeve 283.

The ribs 286 extend from the base of the spout 256 just over half the height and the spout 256 is provided with an external annular lip 287 adjacent the upper end. The grooves extend from the base of the sleeve 283 just over half the height and terminate in an internal shoulder 288 leading to a bore portion 289 of increased diameter.

The annular lip 287 on the spout 256 is a clearance fit in the bore portion 289 and the shoulder 288 is engageable with the lip 287 in the open condition of the valve device 280 shown in FIG. 17 to retain the sleeve 283 on the spout 256. In the closed condition of the valve device 280 shown in FIG. 16, the end wall 284 of the sleeve 283 abuts the outer end of the spout 256.

The sleeve 283 is additionally provided at the lower end with a pair of diametrically opposed arms 290 that extend downwardly, generally parallel to the body 252, and terminate at the outer ends in upwardly curved finger grips or pulls 291.

Each arm 290 is provided with an upstanding retainer hook 292 spaced from the sleeve 283 and terminating at the upper end in a striker head 293 having a chamfer face 294 opposite the sleeve 283 leading to an undercut locking rib 295.

Figure 20:
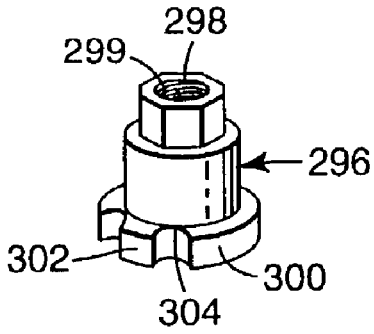
FIG. 20 is a perspective view of an adapter for connecting the reservoir of FIG. 16 to a spray gun.

The sleeve 283 is a push fit in one end of an adapter 296 (see FIGS. 20 and 21) and has an external annular rib 297 providing a fluid-tight seal with the adapter 296. The other end of the adapter 296 is provided with an internal screw thread 298 or other suitable means for releasable connection to the spray gun 1 (FIG. 1).

The adapter 296 has a through bore 299 for transferring paint from the reservoir 251 to the spray gun 1 and is provided with an external collar 300 at one end for releasable engagement with the retainer hooks 292 to secure the reservoir 251.

Figure 21:
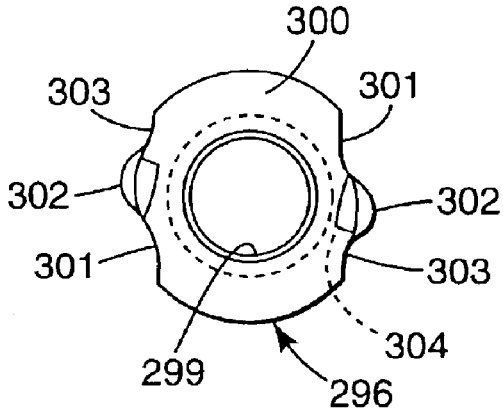
FIG. 21 is a plan view of the adapter shown in FIG. 20.

As best shown in FIG. 21, the collar 300 has major cylindrically concave recesses 301 along opposite sides of its periphery arranged to allow the striker heads 293 of the retainer hooks 292 to pass when the sleeve 283 is pushed into the end of the adapter 296. The reservoir 251 can then be rotated relative to the adapter 296 to cause the retainer hooks 292 to engage convex cam lobes 302 that deflect the hooks 292 outwardly. The lobes 302 lead to minor cylindrically concave recesses 303 and the hooks 292 are received in the recesses 303 to position the locking ribs 295 over a surface 304 of the collar 300 to axially retain the reservoir 251 on the adapter 296.

The retainer hooks 292 can be released to remove the reservoir 251 from the adapter 296 by manually gripping the finger grips 291 and pulling the arms 290 towards the body 252. This causes the retainer hooks 292 to deflect outwardly so as to disengage the locking ribs 295 from the surface 304 of the adapter 296 and allow the sleeve 283 to be pulled out of the adapter 296 to detach the reservoir 251.

In use, the adapter 296 is secured to the spray gun 1 and the pre-filled reservoir 251 attached with the valve 280 closed by pushing the sleeve 283 into the end of the adapter 296 and rotating the reservoir 251 to engage the locking ribs 295. The reservoir 251 can be inverted with the valve 280 closed for attaching to the spray gun 1 with the spray gun 1 in its normal, upright position of use without any risk of spillage of paint from the reservoir 251.

In this way, the spray gun 1 does not have to be inverted when connecting the reservoir 251 to the spray gun 1 thereby facilitating attaching the reservoir 251 to the spray gun 1. In particular, it will be appreciated that less manual dexterity is required when fitting the reservoir 251 from above the spray gun 1 compared to arrangements in which the spray gun 1 must be inverted and the reservoir connected from below to prevent spillage of the paint from the reservoir.

Figure 16:
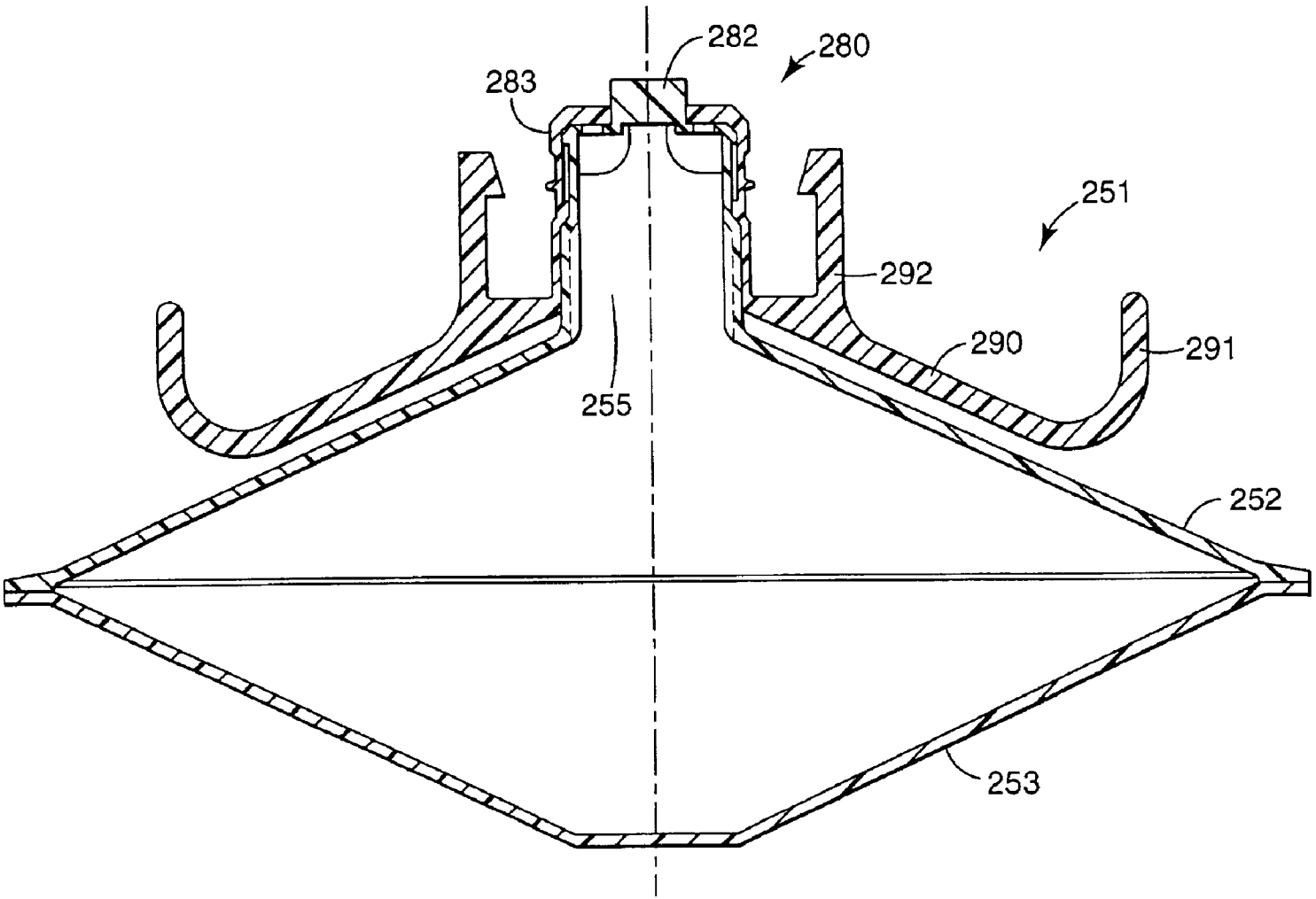
FIG. 16 shows a still further modification to the reservoir of FIG. 11 to provide the spout with a valve device, the valve device being shown closed.

As will be appreciated, the action of pushing and rotating to lock the reservoir 251 to the adapter 296 maintains the valve device 280 in the closed position shown in FIG. 16. When it is desired to commence spraying, the spout 256 is displaced axially relative to the sleeve 283 by pulling the body 252 away from the spray gun 1 to move the valve device 280 to the open position shown in FIG. 17. The spray gun 1 can then be operated as described previously and paint is delivered to the spray gun 1 through the open ports in the spout 256 and the opening 285 in the end wall 284 of the sleeve 283.

On completion of spraying, spray gun 1 can be inverted to allow paint to drain back into the reservoir 251. The valve device 280 can then be returned to the closed position shown in FIG. 16 by pushing the body 252 towards the spray gun 1 to re-position the plug 282 in the opening 285 and seal the ports in the end of the spout 256. The reservoir 251 can then be detached from the spray gun 1 by pulling the finger grips 291 towards the body 252 to release the locking ribs 295 as described previously. The reservoir 251 can then be detached by continuing to pull the finger grips 251 to disengage the sleeve 283 from the adapter 296.

As will be appreciated the action of pulling the finger grips 291 to first release the locking ribs 295 from the adapter 296 and then remove the sleeve 283 from the adapter 296 maintains the valve device 280 in the closed position.

When the reservoir 251 is detached from the spray gun 1, it can be put to one side to store any unused paint for later use if required or thrown away. When storing unused paint in the reservoir 251 for re-use, the plug 282 can be wiped clean to prevent any paint drying and providing a source of contamination when it is desired to re-use the stored paint. This also prevents any paint drying and preventing the valve device 280 being opened when the reservoir 251 is re-attached to the spray gun 1. The valve device 280 also prevents entry of any external contaminants to the paint while it is being stored in the reservoir 251.

It will be understood that the valve device 280 may be employed with any of the other reservoirs 51,151 previously described according to the present invention. It will also be understood that any of the features of the various embodiments of the reservoir 51,151,251 according to the present invention may be employed with any of the other embodiments separately or in combination.

For example, the retainer hooks 295 for securing the reservoir 251 to the spray gun 1 with the adapter 296 may be used in place of the bayonet formations and adapter 18 to secure any of the other reservoirs 51,151. The sealable plug 60 in the body 52 of the reservoir 51 shown in FIG. 9 may be provided in the body 152,252 of the other reservoirs 151,251. The skirt 71 or dependent projections shown in FIG. 10 may be provided on the body 152,252 of any of the other reservoirs 151,251 to provide a rigid support for standing the reservoir 151,251 in an upright position.

In the above-described embodiments, the reservoir 51,151,251 contains a single liquid with the option of a sealable plug providing a one-way entry port in the wall of the rigid body for introducing another component. It will be understood, however that the reservoir could have internal compartments separated by a rupturable membrane whereby reactive components may be stored separately and mixed immediately prior to use.

As will now be appreciated, the present invention provides a reservoir of simple construction that is collapsible in a reliable, controlled manner to ensure that substantially all of the liquid in the reservoir can be dispensed. Moreover, the arrangement of a flexible diaphragm collapsible into a rigid body is such that stability of the reservoir on the spray gun is maintained when the reservoir is full, partially full and empty. As a result, the reservoir can be connected to the spray gun, partially used, disconnected, stored for later use and discarded when empty or no longer required.

The present invention further provides a reservoir that is especially suitable for supply to the end user pre-filled with the liquid to he dispensed. In this way, the end user only has to select and attach the appropriate reservoir and, after use, the reservoir can be removed and either stored for further use or thrown away. As a result, exposure of the user to health risks associated with handling the liquid is avoided and, after use, only the spray gun requires cleaning.

It will be understood, however, that the present invention is not limited to pre-filled reservoirs for supply to the end user. Thus, the benefits and advantages of the reservoir constructions described herein that provide for substantially complete dispense of the liquid may be applied to reservoirs that are supplied empty for the end user to fill and attach to the spray gun.

It will be appreciated that the exemplary embodiments described herein are intended to illustrate the diverse range and application of the invention and that features of the embodiments may be employed separately or in combination with any other features of the same or different embodiments.

It will be understood that the invention is not limited to the exemplary embodiments and that various modifications and improvements can be made within the spirit and scope of the invention as generally described herein.

What is claimed is:

1. A reservoir for use with a liquid spraying apparatus, the reservoir having a substantially rigid first part for releasable connection to the liquid spraying apparatus wherein the internal surface of the first part extends between an upper, apex end and a lower, base end that is wider than the apex end, and having an opening at the upper, apex end for connecting the reservoir to the apparatus through which liquid can be withdrawn for supply to the apparatus, and a flexible second part connected to the first part at the lower, base end opposite the opening, the second part comprising an elastic diaphragm of extensible material and having an internal surface defining with an internal surface of the first part a chamber containing the liquid wherein the second part is arranged to reduce the volume of the chamber as the liquid is withdrawn from the chamber in use and to conform substantially to the internal surface of the first part in a collapsed condition of the reservoir.

2. A reservoir according to claim 1 wherein the diaphragm is made of elastomer.

3. A reservoir according to claim 1 wherein the diaphragm is arranged to extend in a substantially flat condition across the lower, base end of the first part when the reservoir is filled with liquid.

4. A reservoir according to claim 3 wherein the reservoir can stand in an upright position supported by the base end of the first part.

5. A reservoir according to claim 1 wherein, in use, the diaphragm stretches and deforms inwardly towards the opening to reduce the volume of the chamber when liquid is withdrawn from the reservoir.

6. A reservoir according to claim 1 wherein means is provided to prevent the opening being closed-off by the flexible member when liquid is withdrawn from the reservoir in use.

7. A reservoir according to claim 1 wherein the opening in the first part is provided with a spout for connecting the reservoir to the spray gun in a fluid tight manner.

8. A reservoir according to claim 7 wherein the spout may be detachably secured to an adapter attached to the spray gun.

9. A reservoir according to claim 8 wherein the reservoir and adapter are provided with co-operating formations for releasably securing the reservoir.

10. A reservoir according to claim 9 wherein the formations are engageable with a push/twist action to lock the reservoir in position.

11. A reservoir according to claim 1 wherein a filter is provided to remove any unwanted solid particles from liquid withdrawn from the reservoir to the spray gun in use.

12. A reservoir according to claim 1 wherein the first part has a size and shape that can be held by the user to attach and detach the reservoir without compressing the liquid in the reservoir.

13. An assembly comprising a liquid spraying apparatus and the reservoir of claim 1.

14. The assembly of claim 13, wherein the liquid spraying apparatus is a spray gun.

15. The assembly of claim 14, wherein the spray gun is gravity fed.

16. The assembly of claim 14, wherein the spray gun is pressure fed.

17. A reservoir according to claim 1 wherein the first and second parts are formed separately and permanently united to form the reservoir.

18. A reservoir according to claim 1, wherein the first and second parts are formed integrally in one piece.

19. A reservoir according to claim 1, wherein the internal surface of the first part is curved in axial section.

20. A reservoir according to claim 1 wherein the internal surface of the first part is part spherical.

* * * * *